US009441457B2

(12) United States Patent
Robison et al.

(10) Patent No.: US 9,441,457 B2
(45) Date of Patent: Sep. 13, 2016

(54) INDEXING SLEEVE FOR SINGLE-TRIP, MULTI-STAGE FRACING

(71) Applicant: Weatherford/Lamb, Inc., Houston, TX (US)

(72) Inventors: Clark E. Robison, Tomball, TX (US); Robert Coon, Missouri City, TX (US); Robert Malloy, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 252 days.

(21) Appl. No.: 13/848,376

(22) Filed: Mar. 21, 2013

(65) Prior Publication Data

US 2013/0220603 A1 Aug. 29, 2013

Related U.S. Application Data

(63) Continuation of application No. 13/022,504, filed on Feb. 7, 2011, now Pat. No. 8,403,068, which is a continuation-in-part of application No. 12/753,331, filed on Apr. 2, 2010, now Pat. No. 8,505,639.

(51) Int. Cl.

| | |
|---|---|
| ***E21B 33/124*** | (2006.01) |
| ***E21B 34/14*** | (2006.01) |
| ***E21B 23/00*** | (2006.01) |
| ***E21B 43/14*** | (2006.01) |
| ***E21B 43/26*** | (2006.01) |

(52) U.S. Cl.

CPC ..... *E21B 34/14* (2013.01); *E21B 23/006* (2013.01); *E21B 43/14* (2013.01); *E21B 43/26* (2013.01)

(58) Field of Classification Search

CPC ..... E21B 33/12; E21B 33/124; E21B 34/14; E21B 43/26

See application file for complete search history.

(56) References Cited

U.S. PATENT DOCUMENTS

| | | | |
|---|---|---|---|
| 3,054,415 | A | 9/1962 | Baker et al. |
| 4,099,563 | A | 7/1978 | Hutchison et al. |

(Continued)

FOREIGN PATENT DOCUMENTS

| | | |
|---|---|---|
| EP | 0618347 | 10/1994 |
| GB | 2402954 | 12/2004 |

(Continued)

OTHER PUBLICATIONS

Examiner's First Report in counterpart Australian Appl. No. 2011201418, dated Feb. 22, 2012.

(Continued)

*Primary Examiner* — Catherine Loikith

(74) *Attorney, Agent, or Firm* — Blank Rome, LLP

(57) ABSTRACT

A flow tool has a sensor that detects plugs (darts, balls, etc.) passing through the tool. An actuator moves an insert in the tool once a preset number of plugs have passed through the tool. Movement of this insert reveals a catch on a sleeve in the tool. Once the next plug is deployed, the catch engages the plug on the sleeve so that fluid pressure applied against the seated plug through the tubing string can move the sleeve. Once moved, the sleeve reveals ports in the tool communicating the tool's bore with the surrounding annulus so an adjacent wellbore interval can be stimulated. The actuator can use a sensor detecting passage of the plugs through the tool. A spring disposed in the tool can flex near the sensor when a plug passes through the tool, and a counter can count the number of plugs that have passed.

30 Claims, 9 Drawing Sheets

(56) References Cited

U.S. PATENT DOCUMENTS

| | | | |
|---|---|---|---|
| 4,520,870 | A | 6/1985 | Pringle |
| 4,574,894 | A | 3/1986 | Jadwin |
| 4,823,882 | A | 4/1989 | Stokley et al. |
| 4,893,678 | A | 1/1990 | Stokley et al. |
| 4,907,649 | A | 3/1990 | Bode |
| 4,967,841 | A | 11/1990 | Murray |
| 5,082,062 | A | 1/1992 | Wood et al. |
| 5,146,992 | A | 9/1992 | Baugh |
| 5,244,044 | A | 9/1993 | Henderson |
| 5,499,687 | A | 3/1996 | Lee |
| 6,041,857 | A | 3/2000 | Carmody et al. |
| 6,155,350 | A | 12/2000 | Melenyzer |
| 6,172,614 | B1 | 1/2001 | Robison et al. |
| 6,253,861 | B1 | 7/2001 | Carmichael et al. |
| 6,343,649 | B1 | 2/2002 | Beck et al. |
| 6,349,766 | B1 | 2/2002 | Bussear et al. |
| 6,464,008 | B1 | 10/2002 | Roddy et al. |
| 6,634,428 | B2 | 10/2003 | Krauss et al. |
| 6,907,936 | B2 | 6/2005 | Fehr et al. |
| 6,920,930 | B2 | 7/2005 | Allamon et al. |
| 7,252,152 | B2 | 8/2007 | LoGiudice et al. |
| 7,322,417 | B2 | 1/2008 | Rytlewski et al. |
| 7,347,289 | B2 | 3/2008 | Lee |
| 7,377,321 | B2 | 5/2008 | Rytlewski |
| 7,387,165 | B2 | 6/2008 | Lopez de Cardenas et al. |
| 7,581,596 | B2 | 9/2009 | Reimert et al. |
| 7,661,478 | B2 | 2/2010 | Palmer et al. |
| 8,505,632 | B2 * | 8/2013 | Guerrero et al. ..... 166/373 |
| 2001/0013410 | A1 | 8/2001 | Beck et al. |
| 2003/0052670 | A1 | 3/2003 | Miszewski |
| 2003/0145986 | A1 | 8/2003 | Evans et al. |
| 2006/0124310 | A1 | 6/2006 | Lopez de Cardenas et al. |
| 2006/0207764 | A1 | 9/2006 | Rytlewski |
| 2007/0204995 | A1 | 9/2007 | Hofman et al. |
| 2007/0272411 | A1 | 11/2007 | Lopez De Cardenas et al. |
| 2007/0272413 | A1 | 11/2007 | Rytlewski et al. |
| 2007/0285275 | A1 | 12/2007 | Purkis et al. |
| 2008/0053658 | A1 | 3/2008 | Wesson et al. |
| 2008/0093080 | A1 | 4/2008 | Palmer et al. |
| 2009/0044949 | A1 | 2/2009 | King et al. |
| 2009/0056934 | A1 | 3/2009 | Xu |
| 2009/0084553 | A1 | 4/2009 | Rytlewski et al. |
| 2009/0223663 | A1 | 9/2009 | Snider et al. |
| 2009/0223670 | A1 | 9/2009 | Snider |
| 2009/0308588 | A1 | 12/2009 | Howell et al. |
| 2010/0155055 | A1 | 6/2010 | Ash et al. |
| 2010/0282338 | A1 | 11/2010 | Gerrard et al. |
| 2010/0294514 | A1 | 11/2010 | Crow et al. |
| 2010/0294515 | A1 | 11/2010 | Xu |
| 2011/0067888 | A1 | 3/2011 | Mireles |
| 2011/0278017 | A1 | 11/2011 | Themig et al. |
| 2012/0048556 | A1 | 3/2012 | O'Connell et al. |

FOREIGN PATENT DOCUMENTS

| | | | |
|---|---|---|---|
| WO | 02/068793 | | 9/2002 |
| WO | 2004009955 | | 1/2004 |
| WO | 2008099166 | | 8/2008 |
| WO | 2010/127457 | A1 | 11/2010 |
| WO | 2011/117601 | A2 | 9/2011 |
| WO | 2011/117602 | A2 | 9/2011 |

OTHER PUBLICATIONS

First Office Action in U.S. Appl. No. 12/753,331, mailed Jul. 3, 2012.

Response to First Office Action in U.S. Appl. No. 12/753,331, mailed Jul. 3, 2012.

Third Examination Report in counterpart Australian Appl. 2012200380, dated Oct. 11, 2013.

European Search Report in counterpart EP Appl. No. EP 11 16 0133, dated Sep. 27, 2011.

First Office Action in counterpart Canadian Appl. 2,764,764, dated Jul. 25, 2013.

Examination Report in counterpart European Appl. EP12151459, dated Jan. 10, 2014.

"Delta Stim Sleeve—Designed for Selective Multi-Zone Fracturing or Acidizing Through the Completion," Halliburton (c) 2008.

"SuperFill Diverter," Halliburton (c) 2007.

"Delta Stim Lite Sleeve—Designed for Selective Multi-Zone Fracturing or Acidizing Through the Completion," Halliburton (c) 2009.

"Frac Sleeve," Magnum Oil Tools International, www.magnumoiltools.com.

"PBL—Multiple Activation Autolock Bypass Systems," Drilling Systems International, www.dsi-pbl.com.

"Autolock Bypass System—Technical Info," Drilling Systems International, obtained from http://www.dsi-pbl.com/products/pbl_autolock.php, generated on Oct. 28, 2009.

"Autolock Bypass System—Application," Drilling Systems International, obtained from http://www.dsi-pbl.com/products/pbl_autolock_app.php, generated on Oct. 28, 2009.

"Electro Mechanical—RFID Operated Fall Through Flapper," Petrowell Ltd. (c) 2008 www.petrowell.co.uk.

"Electro Mechanical—RFID Operated FRAC Sleeve," Petrowell Ltd. (c) 2009 www.petrowell.co.uk.

"Downhole Control Valves—WXO and WXA Standard Sliding Sleeves," Weatherford International, Ltd. (c) 2007-2008.

Examiner's First Report in counterpart Australian Appl. No. 2012200380, dated Feb. 22, 2012.

First Office Action in counterpart Canadian Appl. No. 2,735,402, dated Jul. 31, 2012.

First Office Action in counterpart Canadian Appl. 2,857,825, dated Nov. 23, 2015.

* cited by examiner

INDEXING SLEEVE FOR SINGLE-TRIP, MULTI-STAGE FRACING

CROSS-REFERENCE TO RELATED APPLICATION

This is a continuation of U.S. patent application Ser. No. 13/022,504, filed 7 Feb. 2011, which is a continuation-in-part of U.S. patent application Ser. No. 12/753,331, filed 2 Apr. 2010—both of which are incorporated herein by reference in their entireties.

BACKGROUND

During frac operations, operators want to minimize the number of trips they need to run in a well while still being able to optimize the placement of stimulation treatments and the use of rig/frac equipment. Therefore, operators prefer to use a single-trip, multistage fracing system to selectively stimulate multiple stages, intervals, or zones of a well. Typically, this type of fracing systems has a series of open hole packers along a tubing string to isolate zones in the well. Interspersed between these packers, the system has frac sleeves along the tubing string. These sleeves are initially closed, but they can be opened to stimulate the various intervals in the well.

For example, the system is run in the well, and a setting ball is deployed to shift a wellbore isolation valve to positively seal off the tubing string. Operators then sequentially set the packers. Once all the packers are set, the wellbore isolation valve acts as a positive barrier to formation pressure.

Operators rig up fracing surface equipment and apply pressure to open a pressure sleeve on the end of the tubing string so the first zone is treated. At this point, operators then treat successive zones by dropping successively increasing sized balls sizes down the tubing string. Each ball opens a corresponding sleeve so fracture treatment can be accurately applied in each zone.

As is typical, the dropped balls engage respective seat sizes in the frac sleeves and create barriers to the zones below. Applied differential tubing pressure then shifts the sleeve open so that the treatment fluid can stimulate the adjacent zone. Some ball-actuated frac sleeves can be mechanically shifted back into the closed position. This gives the ability to isolate problematic sections where water influx or other unwanted egress can take place.

Because the zones are treated in stages, the smallest ball and ball seat are used for the lowermost sleeve, and successively higher sleeves have larger seats for larger balls. However, practical limitations restrict the number of balls that can be run in a single well. Because the balls must be sized to pass through the upper seats and only locate in the desired location, the balls must have enough difference in their sizes to pass through the upper seats.

To overcome difficulties with using different sized balls, some operators have used selective darts that use onboard intelligence to determine when the desired seat has been reached as the dart deploys downhole. An example of this is disclosed in U.S. Pat. No. 7,387,165. In other implementations, operators have used smart sleeves to control opening of the sleeves. An example of this is disclosed in U.S. Pat. No. 6,041,857. Even though such systems may be effective, operators are continually striving for new and useful ways to selectively open sliding sleeves downhole for frac operations or the like.

The subject matter of the present disclosure is directed to overcoming, or at least reducing the effects of, one or more of the problems set forth above.

SUMMARY

Downhole flow tools or sliding sleeves deploy on a tubing string down a wellbore for a frac operation or the like. The tools have an insert and a sleeve that can move in the tool's bore. Various plugs, such as balls, frac darts, or the like, deploy down the tubing string to selectively isolate various zones of a formation for treatment.

In one arrangement, the insert moves by fluid pressure from a first port in the tool's housing. The insert defines a chamber with the tool's housing, and the first port communicates with this chamber. When the first port in the tool's housing is opened by an actuator, fluid pressure from the annulus enters this open first port and fills the chamber. In turn, the insert moves from a first position to a second position away from the sleeve by the piston action of the fluid pressure.

In another arrangement, the insert is biased by a spring from a first position to a second position. One or more pins or arms retain the biased insert in the first position. When the pins or arms are moved from the insert by an actuator, the spring moves the insert from the first position to the second position away from the sleeve.

For its part, the sleeve has a catch that can be used to move the sleeve. Initially, this catch is inactive when the insert is positioned toward the sleeve in the first position. Once the insert moves away due to filling of the chamber or bias of the spring by the actuator, however, the catch becomes active and can engage a plug deployed down the tubing string to the catch.

In one example, the catch is a profile defined around the inner passage of the sleeve. The insert initially conceals this profile until moved away by the actuator. Once the profile is exposed, biased dogs or keys on a dropped plug can engage the profile. Then, as the plug seals in the inner passage of the sleeve, fluid pressure pumped down the tubing string to the seated plug forces the sleeve to an open condition. At this point, outlet ports in the tool's housing permit fluid communication between the tool's bore and the surrounding annulus. In this way, frac fluid pumped down to the tool can stimulate an isolated interval of the wellbore formation.

A reverse arrangement for the catch can also be used. In this case, the sleeve in the tool has dogs or keys that are held in a retracted condition when the insert is positioned toward the sleeve. Once the insert moves away from the sleeve by the actuator, the dogs or keys extend outward into the interior passage of the sleeve. When a plug is then deployed down the tubing string, it will engage these extended keys or dogs, allowing the sleeve to be forced open by applied fluid pressure.

Regardless of the form of catch used, the indexing sleeve or tool has an actuator for activating when the insert moves away from the sleeve so the next dropped plug can be caught. In one arrangement, the actuator has a sensor, such as a hall effect sensor, and one or more flexure members or springs. When a plug passes through the tool, the flexure members trigger the sensor to count the passage of the plug. Control circuitry of the actuator uses a counter to count how many plugs have passed through the tool. Once the count reaches a preset number, the control circuitry activates a valve, which can be a solenoid valve or other mechanism. The valve can have a plunger or other form of closure for controlling fluid communication to move the insert. Alternatively, the valve can move a pin or arm to release the insert, which then moves by the bias of a spring.

The foregoing summary is not intended to summarize each potential embodiment or every aspect of the present disclosure.

DETAILED DESCRIPTION

Figure 1:
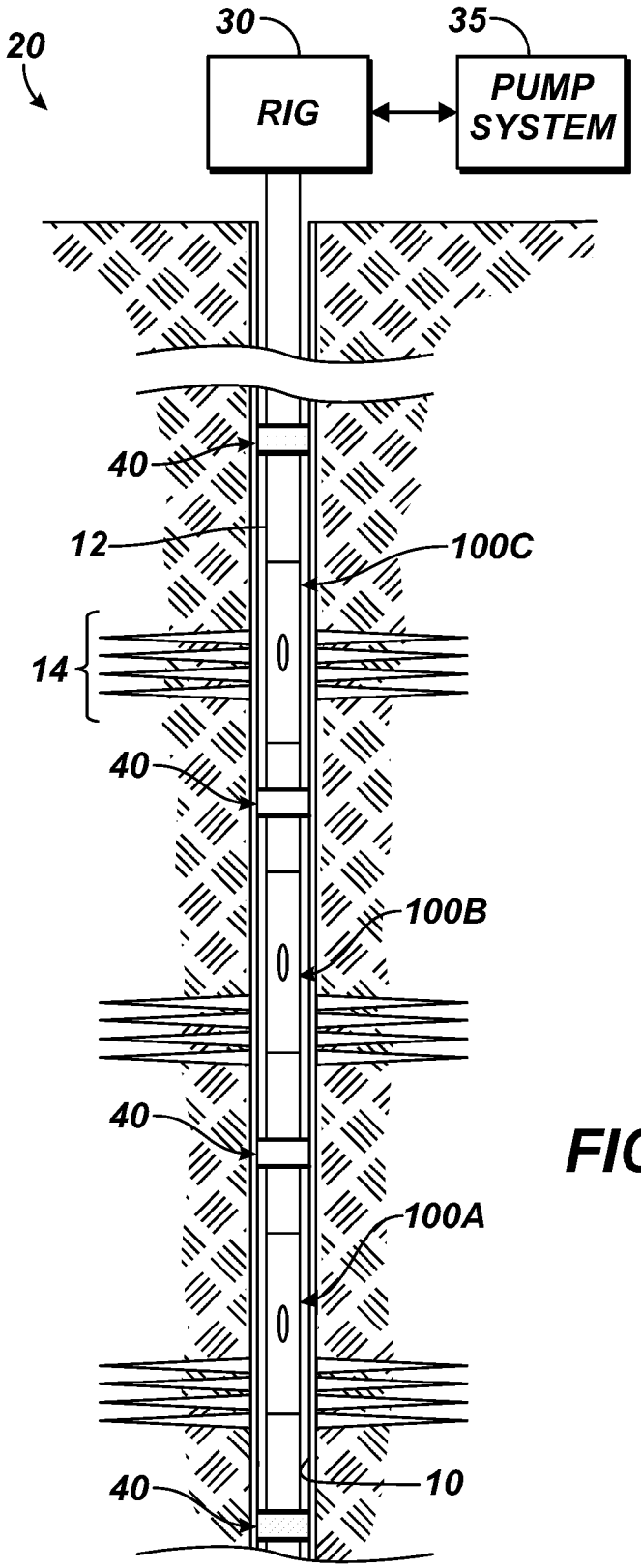
FIG. 1 illustrates a tubing string having indexing sleeves according to the present disclosure.

A tubing string 12 for a wellbore fluid treatment system 20 shown in FIG. 1 deploys in a wellbore 10 from a rig 30 having a pumping system 35. The string 12 has flow tools or indexing sleeves 100A-C disposed along its length. Various packers 40 isolate portions of the wellbore 10 into isolated zones. In general, the wellbore 10 can be an opened or cased hole, and the packers 40 can be any suitable type of packer intended to isolate portions of the wellbore into isolated zones.

The indexing sleeves 100A-C deploy on the tubing string 12 between the packers 40 and can be used to divert treatment fluid selectively to the isolated zones of the surrounding formation. The tubing string 12 can be part of a frac assembly, for example, having a top liner packer (not shown), a wellbore isolation valve (not shown), and other packers and sleeves (not shown) in addition to those shown. If the wellbore 10 has casing, then the wellbore 10 can have casing perforations 14 at various points.

As conventionally done, operators deploy a setting ball to close the wellbore isolation valve (not shown). Then, operators rig up fracing surface equipment and pump fluid down the wellbore to open a pressure actuated sleeve (not shown) toward the end of the tubing string 12. This treats a first zone of the formation. Then, in a later stage of the operation, operators selectively actuate the indexing sleeves 100A-C between the packers 40 to treat the isolated zones depicted in FIG. 1.

The indexing sleeves 100A-C have activatable catches (not shown) according to the present disclosure. Based on a specific number of plugs (i.e., darts, balls or the like) dropped down the tubing string 12, internal components of a given indexing sleeve 100A-C activate and engage the dropped plug. In this way, one sized plug can be dropped down the tubing string 12 to open the indexing sleeve 100A-C selectively.

With a general understanding of how the indexing sleeves 100 are used, attention now turns to details of indexing sleeves 100 according to the present disclosure. Various indexing sleeves 100 are disclosed in co-pending application Ser. No. 12/753,331, which has been incorporated herein by reference.

Figure 2:
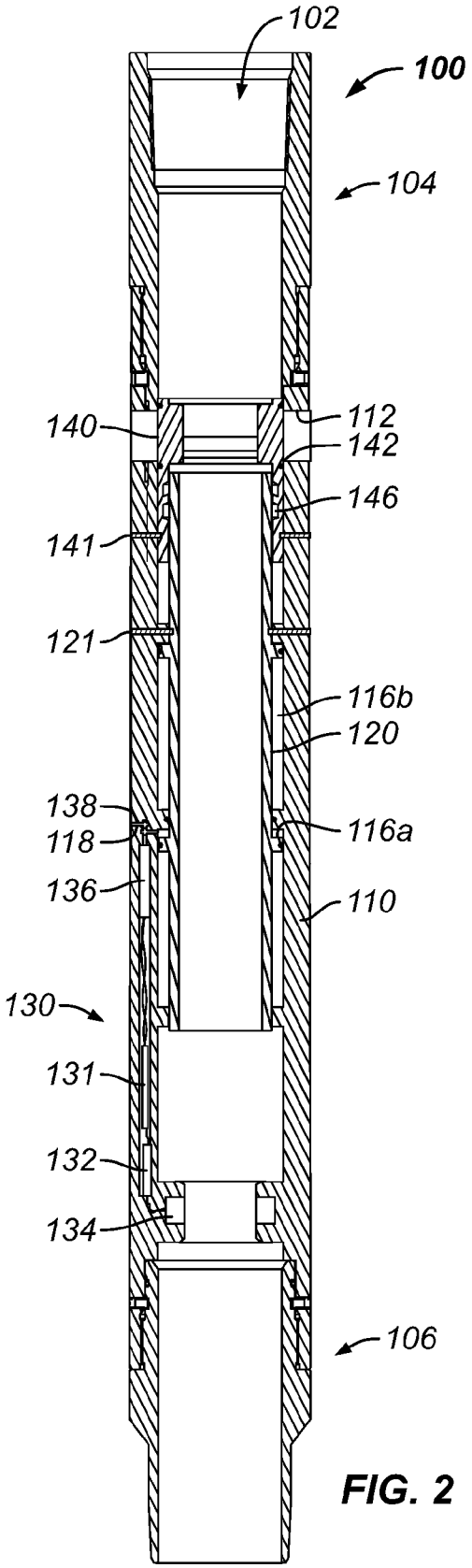
FIG. 2 illustrates an indexing sleeve according to the present disclosure in a closed condition.

One of these indexing sleeves 100 is illustrated in FIG. 2. The indexing sleeve 100 has a housing 110 defining a bore 102 therethrough and having ends 104/106 for coupling to a tubing string (not shown). Inside, the housing 110 has two inserts (i.e., insert 120 and sleeve 140) disposed in its bore 102. The insert 120 can move from a closed position (FIG. 2) to an open position (not shown) when an appropriate plug (e.g., dart 160 of FIG. 4 or other form of plug) is passed through the indexing sleeve 100 as discussed in more detail below. Likewise, the sleeve 140 can move from a closed position (FIG. 2) to an opened position (not shown) when another appropriate plug (e.g. dart 160 or other form of plug) is passed later through the indexing sleeve 100 as also discussed in more detail below.

As shown in FIG. 2, the insert 120 in the closed condition covers a portion of the sleeve 140. In turn, the sleeve 140 in the closed condition covers external ports 112 in the housing 110, and peripheral seals 142 on the sleeve 140 prevent fluid communication between the bore 102 and these ports 112. When the insert 120 has the open condition, the insert 120 is moved away from the sleeve 140 so that a profile 146 on the sleeve 140 is exposed in the housing's bore 102. Finally, the sleeve 140 in the open position is moved away from the ports 112 so that fluid in the bore 102 can pass out through the ports 112 to the surrounding annulus and treat the adjacent formation.

Initially, an actuator or controller 130 having control circuitry 131 in the indexing sleeve 100 is programmed to allow a set number of plugs to pass through the indexing sleeve 100 before activation. Then, the indexing sleeve 100 runs downhole in the closed condition as shown in FIG. 2. To then begin a frac operation, operators drop a plug down the tubing string from the surface. This plug can be intended to close a wellbore isolation valve or open another indexing sleeve.

Figure 4:
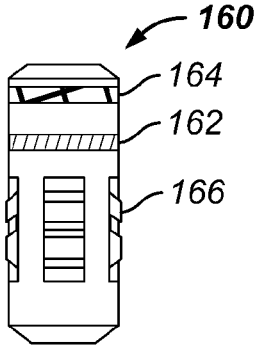
FIG. 4 shows a frac dart for use with the indexing sleeve of FIG. 2.

As shown in FIG. 4, one type of plug for use with the indexing sleeve is a frac dart 160 having an external seal 162 disposed thereabout for engaging in the sleeve (140). The dart 160 also has retractable X-type keys 166 (or other type of dog or key) that can retract and extend from the dart 160. Finally, the dart 160 has a sensing element 164. In one arrangement, this sensing element 164 is a magnetic strip or element disposed internally or externally on the dart 160.

Once the dart 160 is dropped down the tubing string, the dart 160 eventually reaches the indexing sleeve 100 of FIG. 2. Because the insert 120 covers the profile 146 in the sleeve 140, the dropped dart 160 cannot land in the sleeve's profile 146 and instead continues through most of the indexing sleeve 100. Eventually, the sensing element 164 of the dart 160 meets up with a sensor 134 disposed in the housing's bore 102.

Connected to a power source (e.g., battery) 132, this sensor 134 communicates an electronic signal to the control circuitry 131 in response to the passing sensing element 164. The control circuitry 131 can be on a circuit board housed in the indexing sleeve 100 or elsewhere. The signal indicates when the dart's sensing element 164 has met the sensor 134. For its part, the sensor 134 can be a Hall Effect sensor or any other sensor triggered by magnetic interaction. Alternatively, the sensor 134 can be some other type of electronic device. In addition, the sensor 134 could be some form of mechanical or electro-mechanical switch, although an electronic sensor is preferred.

Using the sensor's signal, the control circuitry 131 counts, detects, or reads the passage of the sensing element 164 on the dart 160, which continues down the tubing string (not shown). The process of dropping a dart 160 and counting its passage with the sensor 134 is then repeated for as many darts 160 the sleeve 100 is set to pass. Once the number of passing darts 160 is one less than the number set to open this indexing sleeve 100, the control circuitry 131 activates a valve, motor, or the like 136 on the tool 100 when this second to last dart 160 has passed and generated a sensor signal. Once activated, the valve 136 moves a plunger 138 that opens a port 118 in the housing 110. This communicates a first sealed chamber 116*a* between the insert 120 and the housing 110 with the surrounding annulus, which is at higher pressure.

Figure 3:
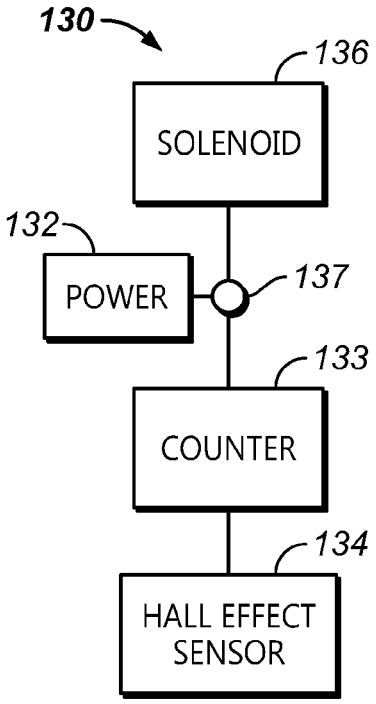
FIG. 3 diagrams portion of an actuator or controller for the indexing sleeve of FIG. 2.

Operation of the actuator or controller 130 in one implementation can be as follows. (For reference, FIG. 3 shows the actuator or controller 130 for the disclosed indexing sleeve 100 in additional detail.) The sensor 134, such as a Hall Effect sensor, responds to the sensing element or magnetic strip 164 of the dart 160 when it comes into proximity to the sensor 134. In response, a counter 133 that is part of the control circuitry 131 counts the passage of the dart's element 162. When a preset count has been reached, the counter 133 activates a switch 137, and a power source 132 activates a solenoid valve 136, which moves a plunger 138 to open the port 118. Although a solenoid valve 136 can be used, any other mechanism or device capable of maintaining a port closed with a closure until activated can be used. Such a device can be activated electronically or mechanically. For example, a spring-biased plunger could be used to close off the port. A filament or other breakable component can hold this biased plunger in a closed state to close off the port. When activated, an electric current, heat, force or the like can break the filament or other component, allowing the plunger to open communication through the port. These and other types of valve mechanisms could be used.

Once the port 118 is opened on the indexing sleeve 100 of FIG. 2, surrounding fluid pressure from the annulus passes through the port 118 and fills the chamber 116*a*. An adjoining chamber 116*b* provided between the insert 120 and the housing 110 can be filled to atmospheric pressure. This chamber 116*b* can be readily compressed when the much higher fluid pressure from the annulus (at 5000 psi or the like) enters the first chamber 116*a*.

In response to the filling chamber 116*a*, the insert 120 shears free of shear pins 121 to the housing 110. Now freed, the insert 120 moves (downward) in the housing's bore 102 by the piston effect of the filling chamber 116*a*. Once the insert 120 has completed its travel, its distal end exposes the profile 146 inside the sleeve 140.

To now open this particular indexing sleeve 100, operators drop the next frac dart 160. This next dart 160 reaches the exposed profile 146 on the sleeve 140 in FIG. 2. The biased keys 166 on the dart 160 extend outward and engage or catch the profile 146. The key 166 has a notch locking in the profile 146 in only a first direction tending to open the sleeve 140. The rest of the key 166, however, allows the dart 160 move in a second direction opposite to the first direction so it can be produced to the surface as discussed later.

The dart's seal 162 seals inside an interior passage or seat in the sleeve 140. Because the dart 160 is passing through the sleeve 140, interaction of the seal 162 with the surrounding sleeve 140 can tend to slow the dart's passage. This helps the keys 166 to catch in the exposed profile 146.

Operators apply frac pressure down the tubing string, and the applied pressure shears the shear pins 141 holding the sleeve 140 in the housing 110. Now freed, the applied pressure moves the sleeve 140 (downward) in the housing to expose the ports 112. At this point, the frac operation can stimulate the adjacent zone of the formation.

Figure 5A:
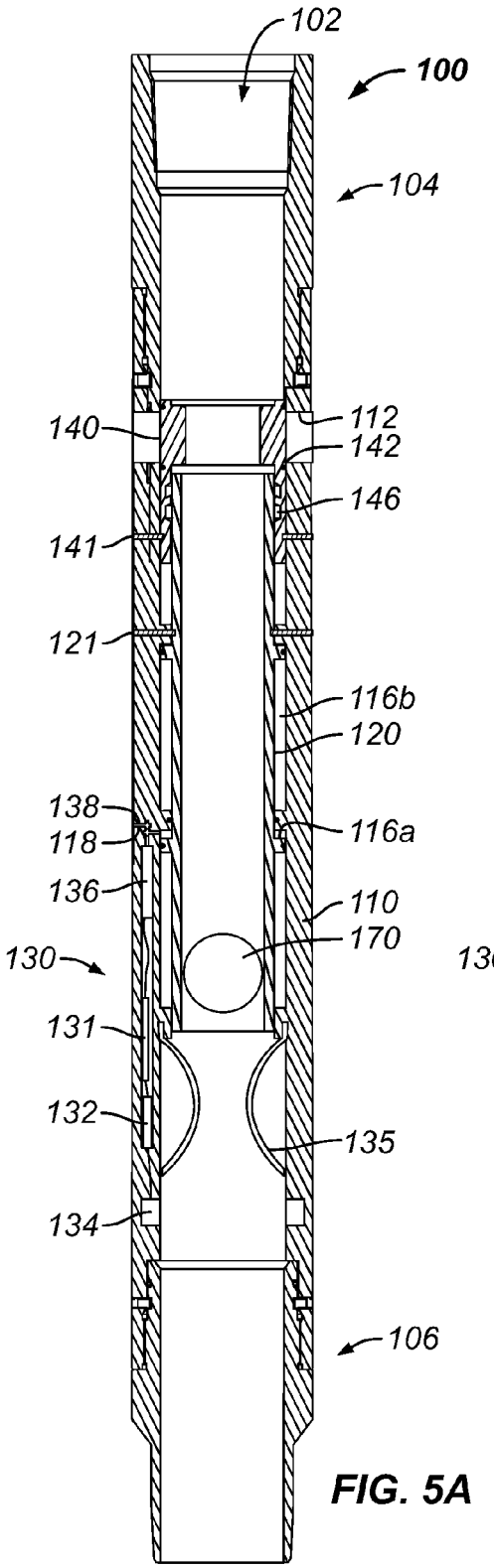
FIGS. 5A-5B illustrate another indexing sleeve according to the present disclosure in a closed condition.
Figure 5B:
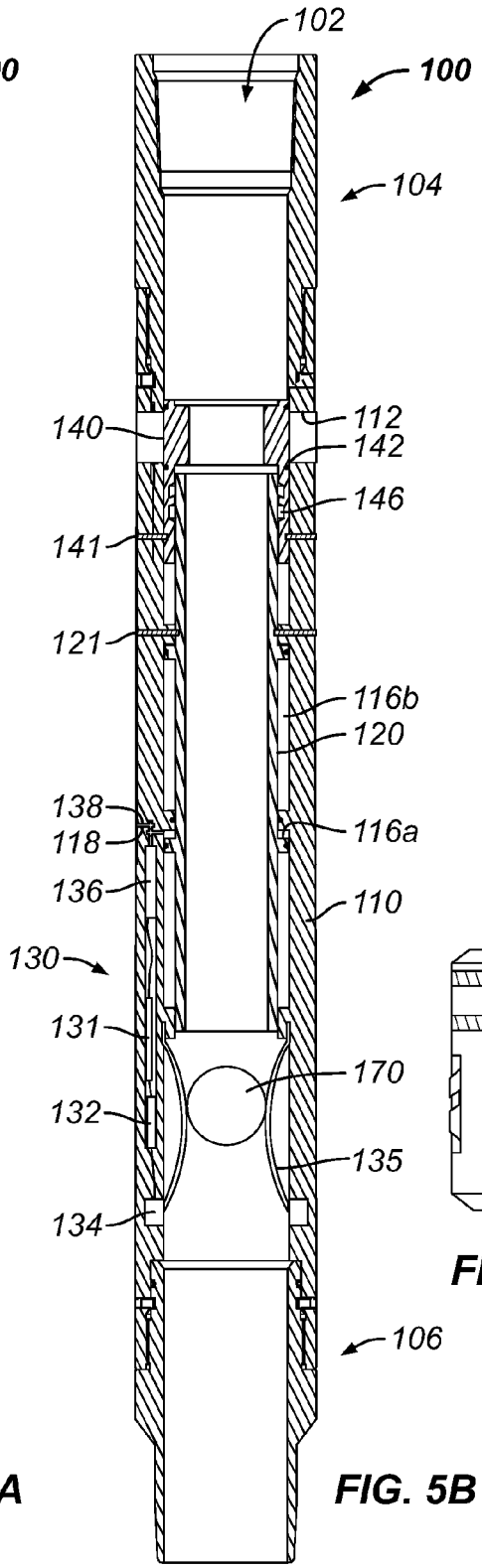

Another indexing sleeve 100 shown in FIGS. 5A-5B has many of the same components as other sleeves disclosed herein so that like reference numbers are used for similar components. The indexing sleeve 100 has a housing 110 defining a bore 102 therethrough and having ends 104/106 for coupling to a tubing string (not shown). Inside, the housing 110 has two inserts (i.e., insert 120 and sleeve 140) disposed in its bore 102. The insert 120 can move from a closed position (FIG. 5A) to an open position (not shown) when an appropriate plug (e.g., ball, dart, or other form of plug) is passed through the indexing sleeve 100 as discussed in more detail below. Likewise, the sleeve 140 can move from a closed position (FIG. 5A) to an opened position (not shown) when another appropriate plug (e.g. ball, dart, or other form of plug) is passed later through the indexing sleeve 100 as also discussed in more detail below.

The indexing sleeve 100 is run in the hole in a closed condition. As shown in FIG. 5A, the insert 120 in the closed condition covers a portion of the sleeve 140. In turn, the sleeve 140 in the closed condition covers external ports 112 in the housing 110, and peripheral seals 142 on the sleeve 140 prevent fluid communication between the bore 102 and these ports 112. When the insert 120 has the open condition, the insert 120 is moved away from the sleeve 140 so that a profile 146 on the sleeve 140 is exposed in the housing's bore 102. Finally, the sleeve 140 in the open position is moved away from the ports 112 so that fluid in the bore 102 can pass out through the ports 112 to the surrounding annulus and treat the adjacent formation.

Initially, the actuator or controller 130 having the control circuitry 131 in the indexing sleeve 100 is programmed to allow a set number of plugs to pass through the indexing sleeve 100 before activation. Then, the indexing sleeve 100 runs downhole in the closed condition as shown in FIGS. 5A-5B. To then begin a frac operation, operators drop plugs down the tubing string from the surface.

As shown in FIG. 5A, a plug 170 is dropped down the tubing string, and the plug 170 eventually reaches the indexing sleeve 100. (This plug 170 is shown as a ball, but can be another type of plug.) Because the insert 120 covers the profile 146 in the sleeve 140, the dropped plug 170 cannot land in the sleeve's profile 146 and instead continues through most of the indexing sleeve 100. Eventually, the plug 170 meets up with one or more flexure members 135 disposed in the housing's bore 102 as shown in FIG. 5B.

The one or more flexure members 135 can be bow springs or leaf springs disposed around the perimeter of the inside bore 102. In one arrangement, as many as six springs 135 may be used. Each spring 135 is designed to support a portion of the kinetic energy of the plug 170 as it is pumped through the indexing sleeve 100. The force required to pump the plug 170 past the springs 135 can be about 1500-psi, which is observable from the surface during the pumping operations.

Any number of springs 135 can be used and can be uniformly arranged around the bore 102. The bias of the springs 135 can be configured for a particular implementation, expected pressures, expected number of plugs to pass, and other pertinent variables. The springs 135 are robust enough to provide a surface indication, but they are preferably not prone to stick due to the presence of frac proppant materials.

The sensor 134 is connected to a power source (e.g., battery) 132. When the plug 170 engages the springs 135, forced pumping of the plug 170 down the sleeve 100 causes the plug 170 to flex or extend the springs 135. As the springs are flexed or extended due to the plug's passage, the springs 135 elongate. At full extension, ends of the springs 135 engage the sensor 134 in the bore 102, and the presence of the tip of the spring 135 near the sensor 134 indicates passage of a plug.

The sensor 134 communicates an electronic signal to the control circuitry 131 of the actuator or controller 130 in response to the spring contact. (The indexing sleeve of FIGS. 5A-5B can use an actuator 130 similar to that disclosed previously in FIG. 3.) The control circuitry 131 can be on a circuit board housed in the indexing sleeve 100 or elsewhere. The signal indicates when the plug 170 has moved into or past the springs 135. For its part, the sensor 134 can be a Hall Effect sensor or any other sensor triggered by interaction with the spring 135. Alternatively, the sensor 134 can be some other type of electronic device. In addition, the sensor 134 could be some form of mechanical or electro-mechanical switch, although an electronic sensor is preferred.

Using the sensor's signal, the control circuitry 131 counts, detects, or reads the passage of the plug 170, which continues down the tubing string (not shown). The process of dropping a plug 170 and counting its passage with the sensor 134 is then repeated for as many plugs 170 the sleeve 100 is set to pass. Once the number of passing plugs 170 is one less than the number set to open this indexing sleeve 100, the control circuitry 131 activates a valve 136 on the sleeve 100 when this second to last plug 170 has passed and generated a sensor signal.

Once activated, the valve 136 moves a plunger 138 that opens a port 118, and the filling chamber 116*a* shears the insert 120 free of shear pins 121 to the housing 110. Now freed, the insert 120 moves (downward) in the housing's bore 102 by the piston effect. Once the insert 120 has completed its travel, its distal end exposes the profile 146 inside the sleeve 140. To now open this particular indexing sleeve 100, operators drop the next plug, which can be a frac dart 180 as in FIG. 6.

Figure 6:
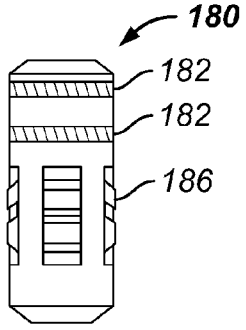
FIG. 6 shows a frac dart for use with the indexing sleeve of FIGS. 5A-5B.

As shown in FIG. 6, the plug that can be used to index and open the sleeve can be a frac dart 180. This frac dart 180 is similar to that described previously. The dart 180 has an external seal 182 disposed thereabout for engaging in the sleeve (140). The dart 180 also has retractable X-type keys 186 (or other type of dog or key) that can retract and extend from the dart 180. Unlike the previous frac dart, this frac dart 180 can lack a sensing element because interaction of the frac dart 180 with the springs (135) on the indexing sleeve (100) indicates passage of the dart 180.

Figure 7A:
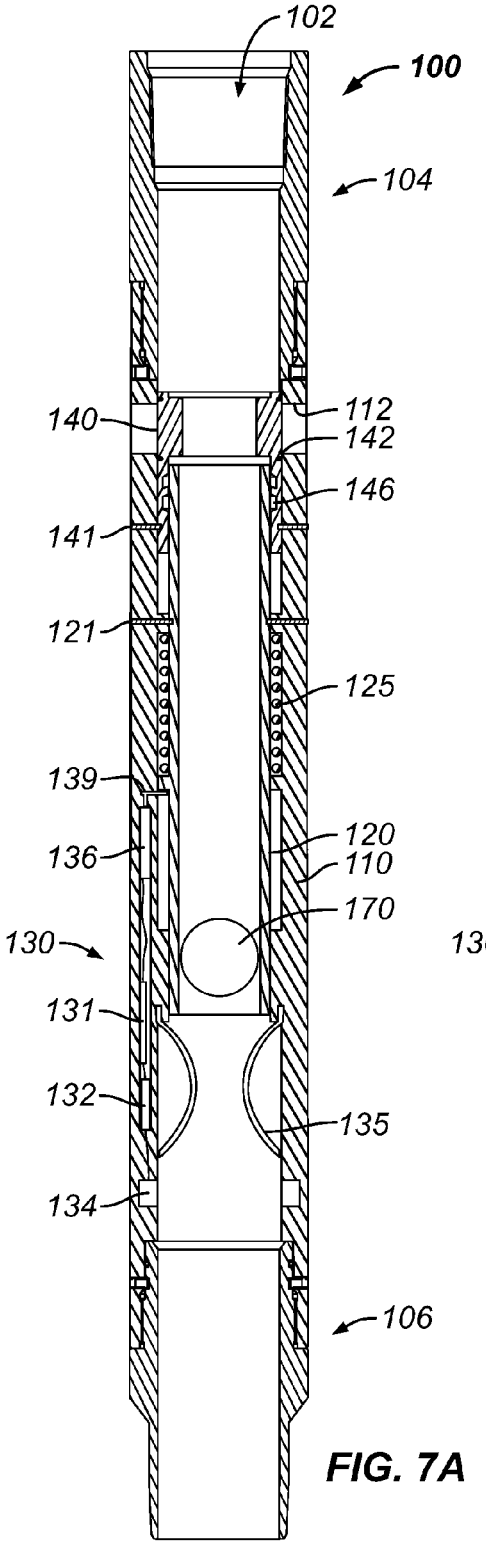
FIGS. 7A-7C illustrate yet another indexing sleeve according to the present disclosure in a closed condition.
Figure 7B:
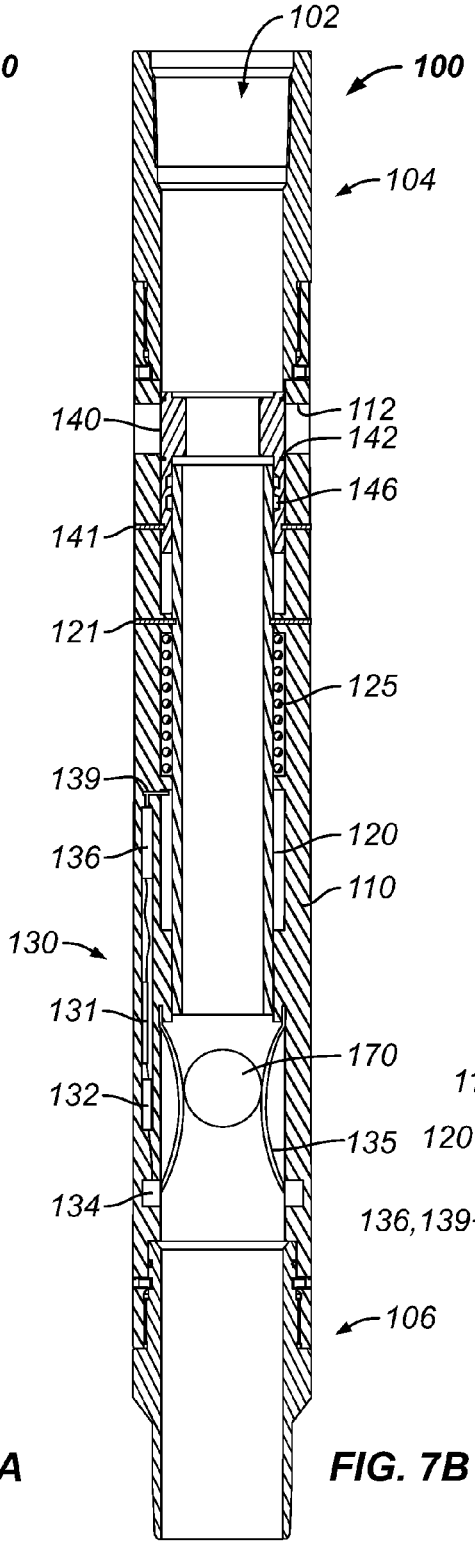
Figure 7C:
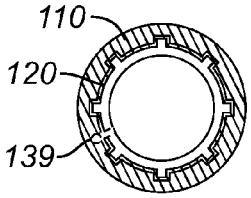

FIGS. 7A-7C illustrate another indexing sleeve 100 according to the present disclosure in a closed condition. The indexing sleeve 100 is similar to that described previously so that the same reference numbers are used for like components. As before, the indexing sleeve 100 runs in the hole in a closed condition, and the insert 120 covers a portion of the sleeve 140. In turn, the sleeve 140 covers external ports 112 in the housing 110.

A dropped plug 170 down the tubing string from the surface eventually engages the springs 135 as shown in FIG. 7B. The sensor 134 detects the interaction of the end of the flexure members or springs 135, and the control circuitry 131 of the actuator 130 counts the passage of the plug 170. The process of dropping a plug 170 and counting its passage with the sensor 134 is then repeated for as many plugs 170 the sleeve 100 is set to pass.

Once the number of passing plugs 170 is one less than the number set to open this indexing sleeve 100, the control circuitry 131 activates a valve, motor, or the like 136 on the sleeve 100 when this second to last plug 170 has passed and generated a sensor signal. Once activated, the valve 136 moves an arm or pin 139 restraining the insert 120. Once the insert 120 is unrestrained, a spring 125 biases the insert 120 in the bore 112 away from the sleeve 140 to expose the profile 146 in the sleeve 140. Further details of this operation are discussed below. Subsequently, when a frac dart is pumped downhole, the frac dart locates on the profile 146 of the sleeve 140 so that frac operations can proceed.

Figure 8A:
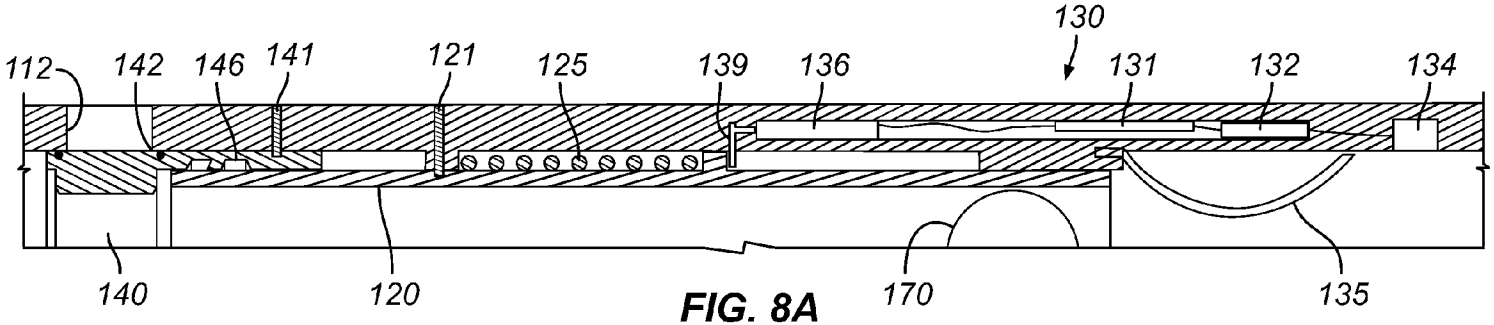
FIGS. 8A-8F show the indexing sleeve of FIGS. 7A-7C in various stages of operation.

FIGS. 8A-8F show the indexing sleeve 100 of FIGS. 7A-7C in various stages of operation. Many of the same operational steps would apply to the other indexing sleeves disclosed herein. As shown in FIG. 8A, the indexing sleeve 100 deploys downhole in a closed condition with the sleeve 140 covering the port 112 and with the insert 120 covering the profile 146 on the sleeve 140. A dropped plug 170 can pass through the indexing sleeve 100.

Figure 8B:
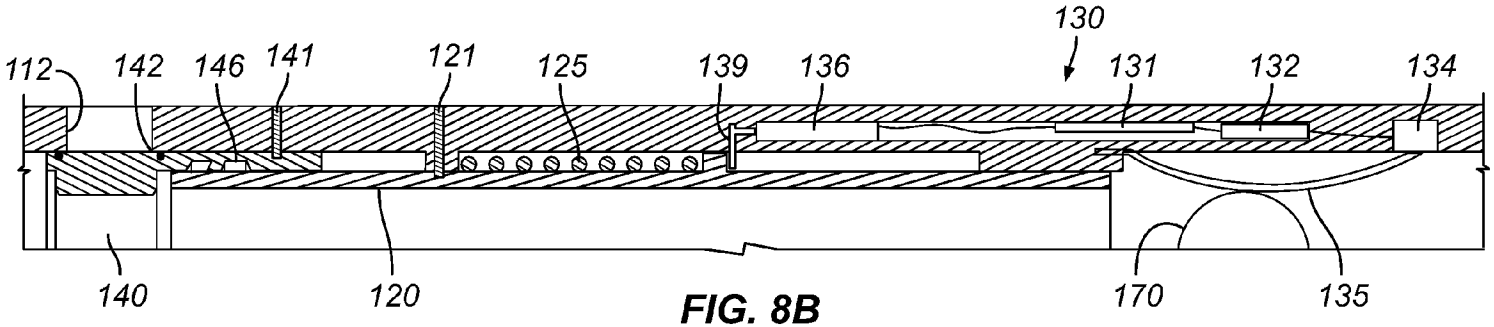
Figure 8C:
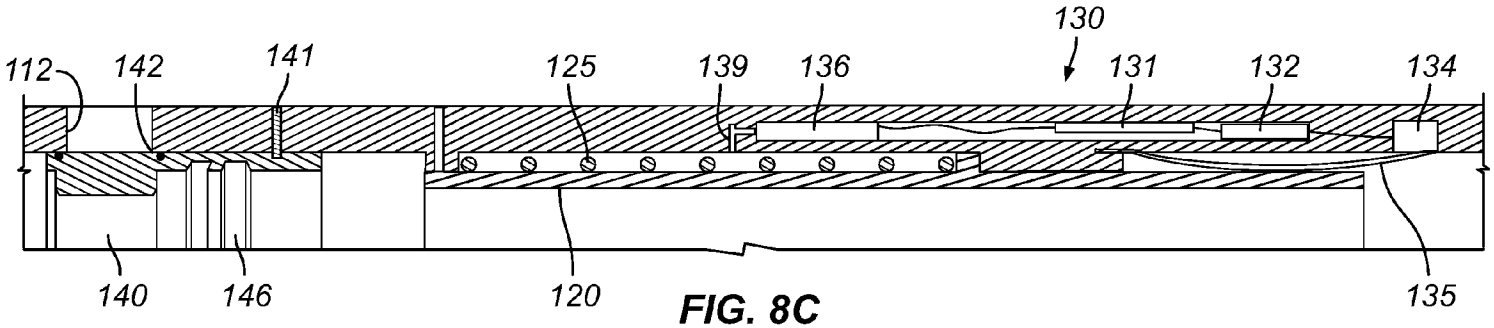

As shown in FIG. 8B, the dropped plug 170 engages the springs 135, and the sensor 134 and control circuitry 131 detects and counts the passage of the plug 170. This process of dropped plugs 170 and counting is repeated until the preset number of plugs 170 has passed through the indexing sleeve 100. At this point shown in FIG. 8C, the control circuitry 131 activates the valve 136, which removes the restraining arm or pin 139 from the insert 120. Now free, the insert 120 moves by the bias of the spring 125 way from the sleeve 140, thereby exposing the sleeve's profile 146.

Figure 8D:
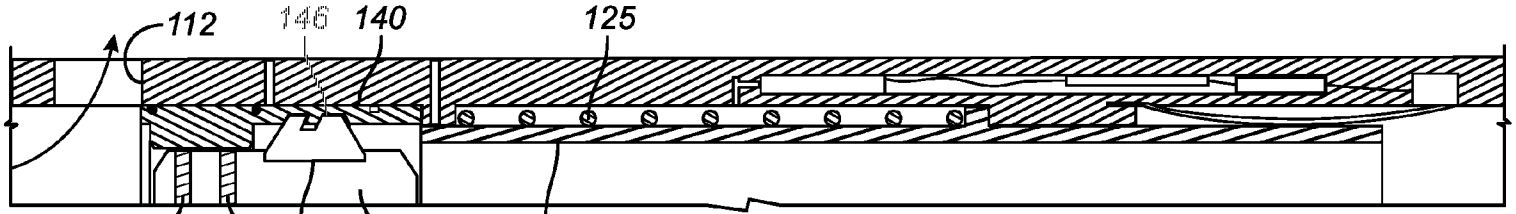

As shown in FIG. 8D, another plug is next dropped down the tubing. In this instance, the plug is a frac dart 180 similar to that described previously with reference to FIG. 6. The dart 180 reaches the exposed profile 146 on the sleeve 140. The biased keys 186 on the dart 180 extend outward and engage or catch the profile 146. The keys 186 have a notch locking in the profile 146 in only a first direction tending to open the sleeve 140. The rest of the key 186, however, allows the dart 180 move in a second direction opposite to the first direction so it can be produced to the surface as discussed later.

The dart's seal 182 seals inside an interior passage or seat in the sleeve 140. Because the dart 180 is passing through the sleeve 140, interaction of the seal 182 with the surrounding sleeve 140 can tend to slow the dart's passage. This helps the keys 186 to catch in the exposed profile 146.

Operators apply frac pressure down the tubing string, and the applied pressure shears the shear pins 141 holding the sleeve 140 in the housing 110. Now freed, the applied pressure moves the sleeve 140 (downward) in the housing to expose the ports 112, as shown in FIG. 8D. At this point, the frac operation can stimulate the adjacent zone of the formation.

Figure 8E:
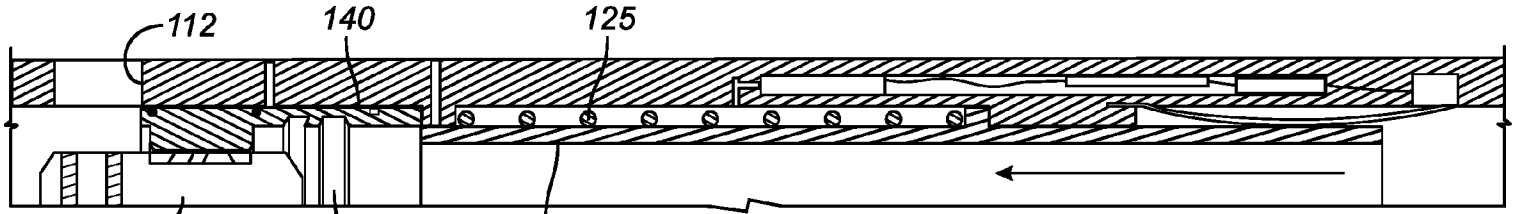
Figure 8F:
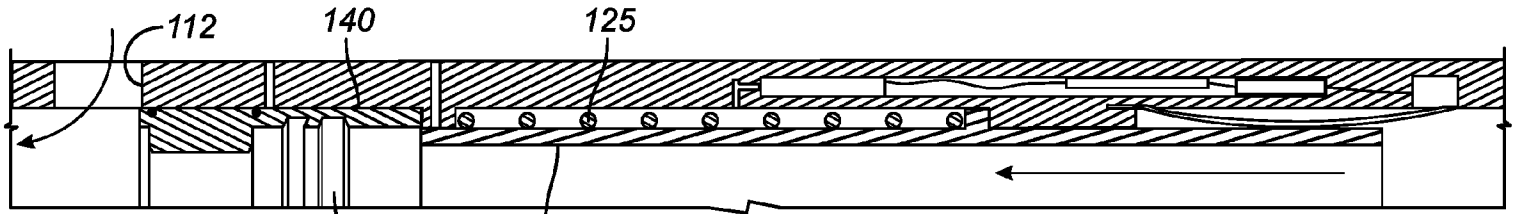

After the zones having been stimulated, operators open the well to production by opening any downhole control valve or the like. Because the dart 180 has a particular specific gravity (e.g., about 1.4 or so), production fluid coming up the tubing and housing bore 102 as shown in FIG. 8E brings the dart 180 back to the surface. If for any reason, the dart 180 does not come to the surface, then the dart 180 can be milled. Finally, as shown in FIG. 8F, the well can be produced through the open sleeve 100 without restriction or intervention. At any point, the indexing sleeve 100 can be manually reset closed by using an appropriate tool.

As disclosed above, energizing the insert 120 in the indexing sleeve 100 can use a number of arrangements. In FIGS. 5A-5B, the actuator 130 uses a piston effect as a chamber fills with pressure and moves the insert 120. In FIGS. 7A-7C, the actuator 130 uses a solenoid and pin arrangement to release the sleeve 120 biased by the spring 125. Other ways to energize the insert 120 can be used, including, hydrostatic chambers, motors, and the like. In addition, a solder plug could be melted to allow movement between two axial members. These and other arrangements can be used.

Figure 9B:
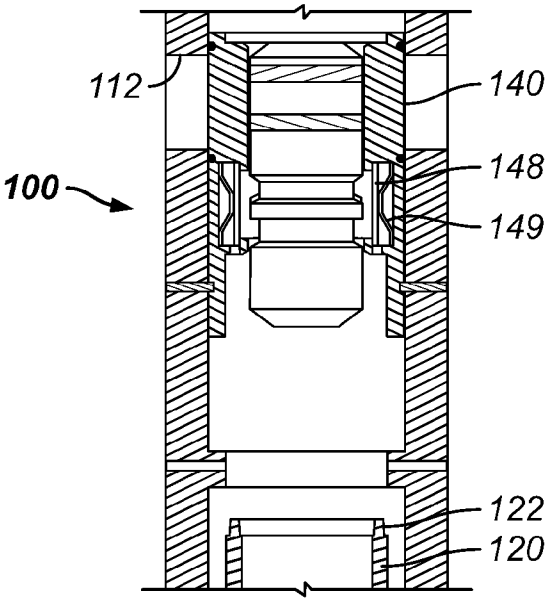
FIGS. 9A-9B illustrate another catch arrangement for an indexing sleeve of the present disclosure.
Figure 9A:
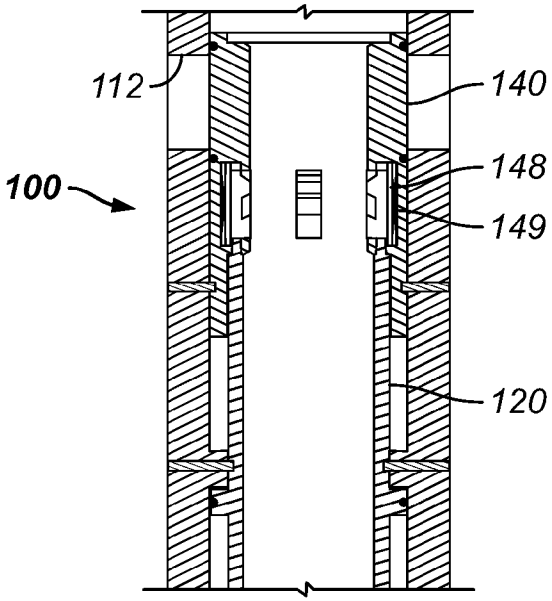

The previous indexing sleeves 100 of FIGS. 2, 5A-5C, and 7A-7C used profiles 146 on the sleeves 140, while the frac darts 160/180 of FIGS. 3 and 6 used biased keys 186 to catch on the profiles 146 when exposed. A reverse arrangement can be used. As shown in FIG. 9A, an indexing sleeve 100 has many of the same components as the previous embodiments so that like reference numerals are used. The sleeve 140, however, has a plurality of keys or dogs 148 disposed in surrounding slots in the sleeve 140. Springs or other biasing members 149 bias these dogs 148 through these slots toward the interior of the sleeve 140 where a frac plug passes.

Initially, these keys 148 remain retracted in the sleeve 140 so that plugs or frac darts can pass as desired. However, once the insert 120 has been activated by one of the darts or other plugs and has moved (downward) in the indexing sleeve 100, the insert's distal end 122 disengages from the keys 148. This allows the springs 149 to bias the keys 148 outward into the bore 102 of the sleeve 100. At this point, the next frac dart 190 of FIG. 10 will engage the keys 148.

Figure 10:
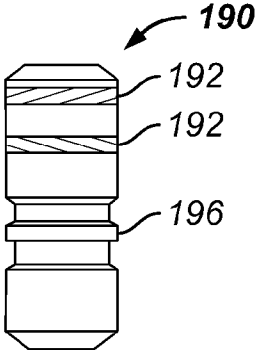
FIG. 10 illustrates a frac dart for the catch arrangement of FIG. 9A-9B.

For example, FIG. 10 shows a frac dart 190 having a seal 192 and a profile 196. As shown in FIG. 9B, the dart 190 meets up to the sleeve 140, and the extended keys 148 catch in the dart's exposed profile 196. At this stage, fluid pressure applied against the caught dart 190 can move the sleeve 140 (downward) in the indexing sleeve 100 to open the housing's ports 112.

The previous indexing sleeves 100 and darts 160/180/190 have keys and profiles for engagement inside the indexing sleeves 100. As an alternative, an indexing sleeve 100 shown in FIG. 11A-11D uses a plug in the form of a ball 170 for engagement inside the indexing sleeve 100. Again, this indexing sleeve 100 has many of the same components as the previous embodiment so that like reference numerals are used. Additionally, the sleeve 140 has a plurality of keys or dogs 148 disposed in surrounding slots in the sleeve 140. Springs or other biasing members 149 bias these dogs 148 through these slots toward the interior of the sleeve 140.

Figure 11C:
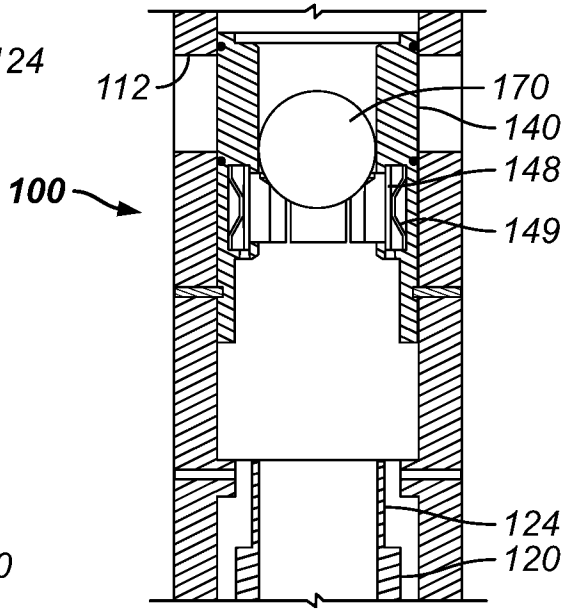
FIGS. 11A-11D illustrate yet another catch arrangement for an indexing sleeve of the present disclosure.
Figure 11B:
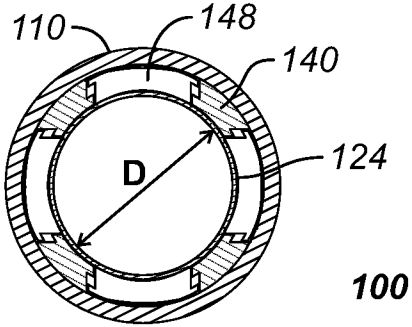
Figure 11D:
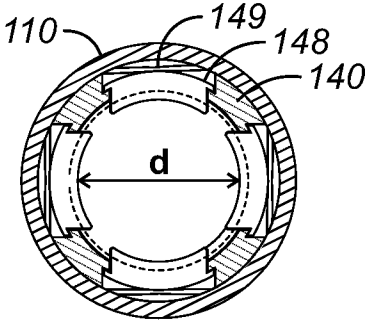
Figure 11A:
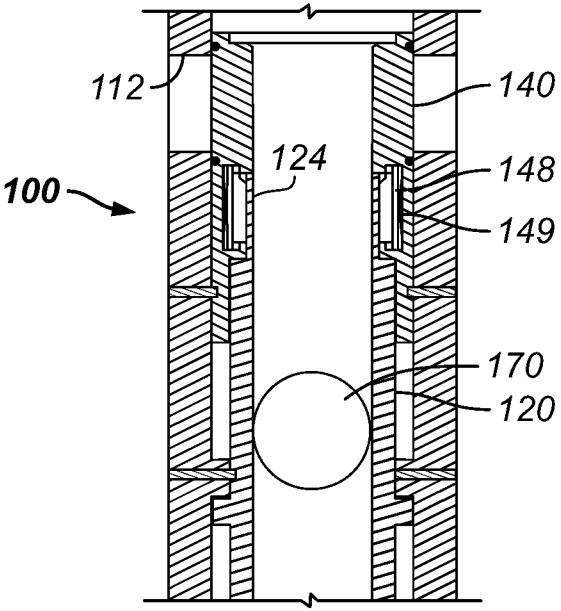

Initially, the keys 148 remain retracted as shown in FIG. 11A-11B. Once the insert 120 has been activated as shown in FIG. 11C-11D, the insert's distal end 124 disengages from the keys 148. Rather than catching internal ledges on the keys 148 as in the previous embodiment, the distal end 124 shown in FIGS. 11A-11B initially covers the keys 148 and exposes them once the insert 120 moves as shown in FIGS. 11C-11D.

Either way, the springs 149 bias the keys 148 outward into the bore 102. At this point, the next ball 170 will engage the extended keys 148. For example, the end-section in FIG. 11B shows how the distal end 124 of the insert 120 can hold the keys 148 retracted in the sleeve 140, allowing for passage of balls 170 through the larger diameter D. By contrast, the end-section in FIG. 11D shows how the extend keys 148 create a seat with a restricted diameter d to catch a ball 170.

As shown, four such keys 148 can be used, although any suitable number could be used. As also shown, the proximate ends of the keys 148 can have shoulders to catch inside the sleeve's slots to prevent the keys 148 from passing out of these slots. In general, the keys 148 when extended can be configured to have ⅛-inch interference fit to engage a corresponding plug (e.g., ball 170). However, the tolerance can depend on a number of factors.

When the dropped ball 170 reaches the extended keys 148 as in FIGS. 11C-11D, fluid pressure pumped down through the sleeve's bore 102 forces against the obstructing ball 170. Eventually, the force releases the sleeve 140 from the pins 141 that initially hold it in its closed condition.

As disclosed herein, the indexing sleeve 100 can have two inserts (e.g., insert 120 and sleeve 140). The sleeve 140 has a catch 146 and can move relative to ports 112 to allow fluid communication between the sleeve's bore 102 and the annulus. Because the insert 120 moves in the housing 110 by the actuator 130, the insert 120 may instead cover a port in the housing 110 for fluid communication. Thus, once the insert 120 is moved, the indexing sleeve 100 can be opened.

Figure 12A:
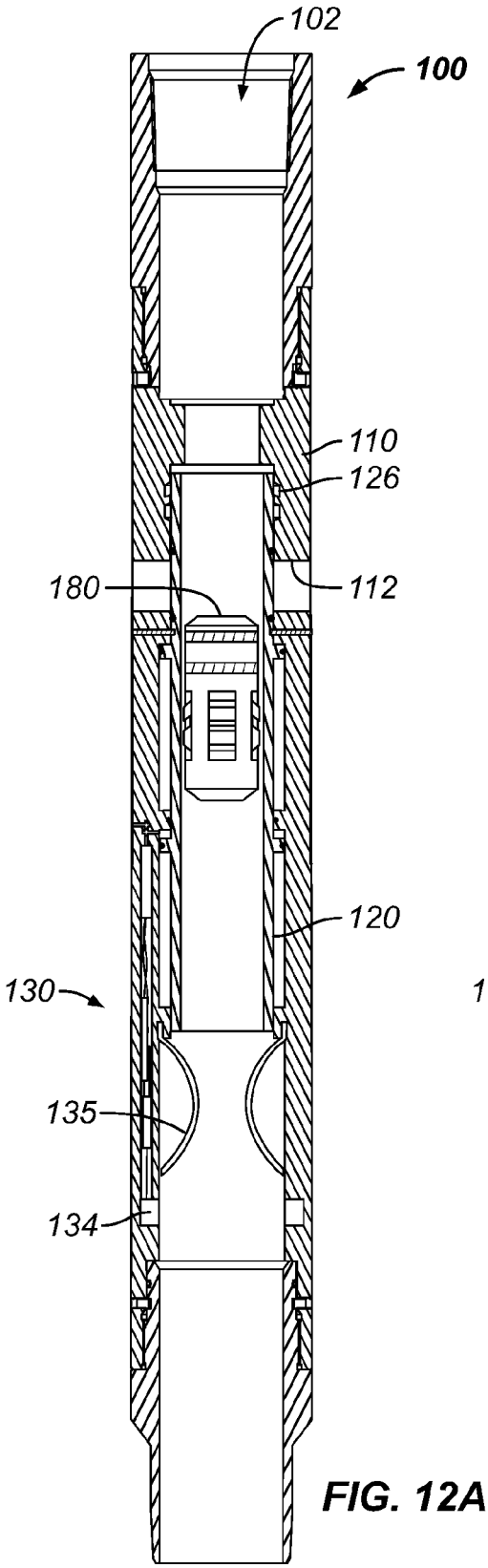
FIGS. 12A-12B illustrates an indexing sleeve having an insert movable relative to ports and a catch in the bore.
Figure 12B:
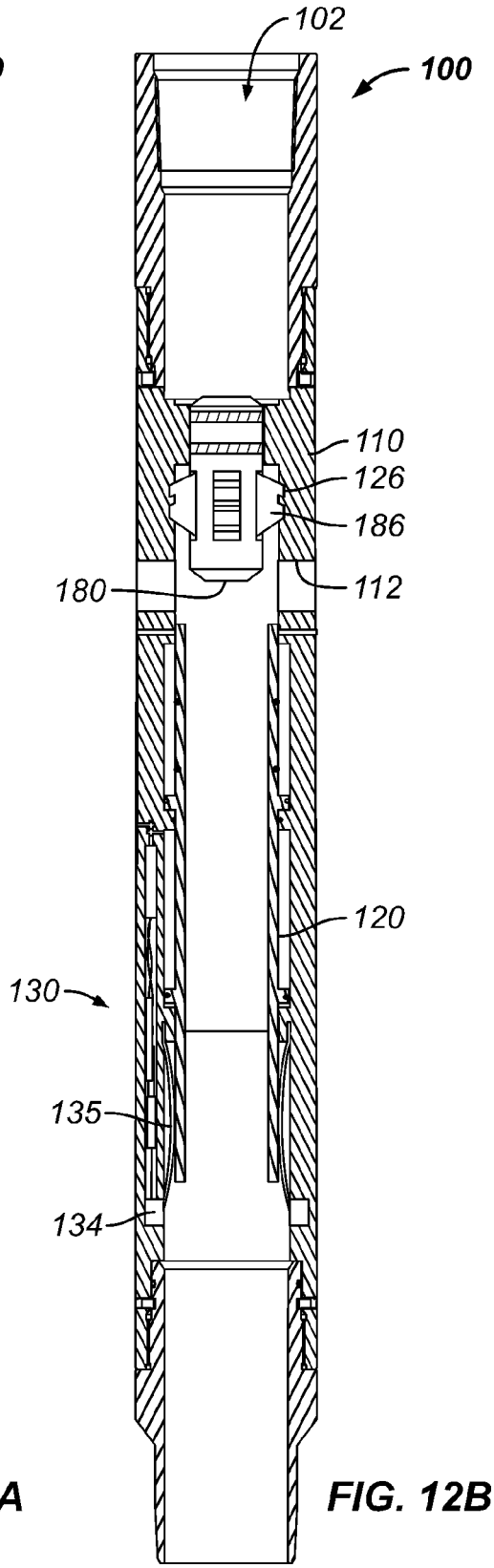

As shown in FIGS. 12A-12B, another indexing sleeve 100 has a housing 110, ports 112, an insert 120, and other components similar to those disclosed previously. This indexing sleeve 100 lacks a second insert or sleeve (e.g., 140) as in previous embodiments. Instead, the catch (i.e., profile 126 or other locking shoulder) is defined in the bore 102 of the housing 110.

A passing dart 180 or other plug interacts with the spring 135 and sensor arrangement 134 or other components of the actuator 130, which moves the insert 120 as discussed previous. When the insert 120 is moved by the actuator 130, it reveals the ports 112 in the housing 110 as shown in FIG. 12B so that the bore 102 communicates with the annulus. At the same time, movement of the insert 120 exposes this fixed catch 126. In this way, the next dropped dart 180 or plug can engage the catch 126 in the bore 102 to close off the lower portion of the tubing string. Depending on the implementation and how various zones of a formation are to be treated, using this form of indexing sleeve 100 may be advantageous for operators.

The indexing sleeves and plugs disclosed herein can be used in conjunction with or substituted for the other indexing sleeves, plugs, and arrangements disclosed in co-pending application Ser. No. 12/753,331, which has been incorporated herein by reference.

The foregoing description of preferred and other embodiments is not intended to limit or restrict the scope or applicability of the inventive concepts conceived of by the Applicants. As described above, a plug can be a dart, a ball, or any other comparable item for dropping down a tubing string and landing in a sliding sleeve. Accordingly, plug, dart, ball, or other such term can be used interchangeably herein when referring to such items. As disclosed herein, the various indexing sleeves disclosed herein can be arranged with one another and with other sliding sleeves. It is possible, therefore, for one type of indexing sleeve and plug to be incorporated into a tubing string having another type of indexing sleeve and plug disclosed herein. These and other combinations and arrangements can be used in accordance with the present disclosure.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A wellbore fluid treatment method, comprising:

deploying sliding sleeves on a tubing string in a wellbore;

deploying plugs down the tubing string; and opening a first of the sliding sleeves for fluid communication between the tubing string and the wellbore by:

counting passage of a first number of the plugs through the first sliding sleeve while a first catch of the first sliding sleeve remains in an inactive condition unable to contact the plugs, activating the first catch to an active condition in response to the first number of the plugs, and catching one of the plugs passing in the first sliding sleeve in the first catch in the active condition.

2. The method of claim 1, wherein opening the first sliding sleeve comprises applying pressure down the tubing string to the plug in the first catch.

3. The method of claim 1, further comprising opening a second of the sliding sleeves uphole of the first sliding sleeve by:

counting passage of a second number of the plugs through the second sliding sleeve;

activating a second catch in response to the second number of the plugs; and catching one of the plugs passing in the second sliding sleeve in the activated second catch.

4. The method of claim 3, wherein opening the second sliding sleeve comprises applying pressure down the tubing string to the plug in the second catch.

5. The method of claim 3, wherein counting passage of the second number of the plugs through the second sliding sleeve comprises counting passage of the second number of the plugs through the second sliding sleeve while the second catch remains in an inactive condition unable to contact the plugs.

6. The method of claim 1, wherein activating the first catch to the active condition in response to the first number of the plugs comprises moving a second insert in the first sliding sleeve relative to the first insert in response to the first number of the plugs, disengaging the second insert from the first catch in the inactive condition, and placing the first catch to the active condition.

7. A wellbore fluid treatment method, comprising:

deploying flow tools on a tubing string in a wellbore;

deploying plugs down the tubing string; and opening a first of the flow tools for fluid communication between the tubing string and the wellbore by:

counting passage of a first number of the plugs through the first flow tool, activating a first catch disposed on a first insert from an inactive condition to an active condition in the first flow tool by moving a second insert in the first flow tool relative to the first insert in response to the first number of the plugs, disengaging the second insert from the first catch in the inactive condition, and placing the first catch on the first insert to the active condition, and catching one of the plugs in the first flow tool with the first catch in the active condition.

8. The method of claim 7, wherein opening the first flow tool comprises:

applying fluid pressure down the tubing string to the plug in the first catch; and moving the first insert in the first flow tool from a closed condition to an opened condition with the applied pressure.

9. The method of claim 7, further comprising opening a second of the flow tools uphole of the first flow tool by:

counting passage of a second number of the plugs through the second flow tool;

activating a second catch disposed on a third insert in the second flow tool from an inactive condition to an active condition in the second flow tool by moving a fourth insert in the second flow tool relative to the third insert in response to the second number of the plugs; and catching one of the plugs in the second flow tool with the second catch in the active condition.

10. The method of claim 9, wherein opening the second flow tool comprises:

applying fluid pressure down the tubing string to the plug in the second catch; and moving the third insert in the second flow tool from a closed condition to an opened condition with the applied pressure.

11. The method of claim 10, wherein deploying the plugs down the tubing string comprises deploying at least first and second sizes of the plugs; wherein catching one of the plugs with the first catch in the active condition comprises catching one of the plugs of the first size with the first catch; and wherein catching one of the plugs with the second catch in the active condition comprises catching one of the plugs of the second size with the second catch.

12. The method of claim 7, wherein moving the second insert in the first flow tool comprises:

opening fluid pressure through a first port in the first flow tool; and moving the second insert in the first flow tool in response to fluid pressure from the first port.

13. The method of claim 7, wherein moving the second insert in the first flow tool comprises moving the second insert in the first flow tool in response to mechanical bias.

14. The method of claim 7, wherein counting the passage of the first number of the plugs through the first flow tool comprises at least partially mechanically responding to the passage of one or more of the plugs.

15. The method of claim 14, wherein at least partially mechanically responding to the passage of the one or more plugs comprises moving a finger disposed in a bore of the first flow tool in response to the passage of the one or more plugs against the finger.

16. The method of claim 7, wherein counting passage of the first number of the plugs through the first flow tool comprises at least partially electronically responding to the passage of one or more of the plugs.

17. The method of claim 16, wherein at least partially electronically responding to the passage of the one or more plugs comprises sensing the passage of one or more sensing elements associated with the one or more plugs.

18. The method of claim 7, wherein counting passage of the first number of the plugs through the first flow tool comprises counting passage of the first number of the plugs through the first flow tool while the first catch remains in the inactive condition unable to contact the plugs.

19. A wellbore fluid treatment system operable with one or more plugs deployed through a tubing string in a wellbore, the system comprising:

a plurality of flow tools deployed on the tubing string, each of the flow tools having a first insert disposed in the flow tool and being movable from a closed condition to an opened condition, the first insert in the opened condition permitting fluid communication between the flow tool and the wellbore, wherein a first of the flow tools comprises:

a first catch disposed on the first insert and initially placed in an inactive condition for passing the plugs, the first flow tool counting passage of a first predetermined number of the one or more plugs through the first flow tool while the first catch remains in the inactive condition unable to engage the one or more plugs, and a second insert disposed in the first flow tool and being movable to place the first catch in an active condition in response to passage of the first predetermined number of the one or more plugs in the first flow tool, the first catch placed in the active condition adapted to engage at least one of the one or more plugs.

20. The system of claim 19, wherein the second insert at least partially mechanically responds to the passage of the one or more plugs.

21. The system of claim 20, wherein to at least partially mechanically respond to the passage of the one or more plugs, the second insert comprises a finger disposed in a bore of the first flow tool and being moveable in response to the passage of the one or more plugs.

22. The system of claim 19, wherein the second insert at least partially electronically responds to the passage of the one or more plugs.

23. The system of claim 22, wherein to at least partially electronically respond to the passage of the one or more plugs, the second insert comprise a sensor sensing the passage of one or more sensing elements associated with the one or more plugs.

24. The system of claim 19, wherein the second insert is movable in the first flow tool from a first position to a second position, the second insert in the first position placing the first catch in the inactive condition, the second insert in the second position placing the first catch in the active condition.

25. The system of claim 24, wherein the second insert is movable from the first position to the second position in response to fluid pressure.

26. The system of claim 24, wherein the second insert is movable from the first position to the second position in response to mechanical bias.

27. The system of claim 19, wherein a second of the flow tools comprises:

a second catch disposed on the first insert of the second flow tool and initially placed in an inactive condition for passing the plugs; and a third insert disposed in the second flow tool and being movable to place the catch in an active condition in response to passage of a second predetermined number of the one or more plugs in the second flow tool, the second catch placed in the active condition adapted to engage at least one of the one or more plugs.

28. The system of claim 27, wherein the first and second predetermined numbers for the first and second flow tools are different.

29. The system of claim 27, wherein the second flow tool counts passage of the second predetermined number of the one or more plugs through the second flow tool while the second catch remains in the inactive condition unable to engage the plugs.

30. The system of claim 19, wherein to place the catch in the active condition in response to passage of the first predetermined number of the one or more plugs in the first flow tool, the second insert moves in the first flow tool relative to the first insert in response to the first predetermined number, disengages from the catch in the inactive condition, and places the catch on the first insert to the active condition.

* * * * *